US010038967B2

(12) United States Patent
Jot et al.

(10) Patent No.: US 10,038,967 B2
(45) Date of Patent: Jul. 31, 2018

(54) AUGMENTED REALITY HEADPHONE ENVIRONMENT RENDERING

(71) Applicant: DTS, Inc., Calabasas, CA (US)

(72) Inventors: Jean-Marc Jot, Aptos, CA (US); Keun Sup Lee, Sunnyvale, CA (US); Edward Stein, Aptos, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 15/423,364

(22) Filed: Feb. 2, 2017

(65) Prior Publication Data

US 2017/0223478 A1 Aug. 3, 2017

Related U.S. Application Data

(60) Provisional application No. 62/290,394, filed on Feb. 2, 2016, provisional application No. 62/395,882, filed on Sep. 16, 2016.

(51) Int. Cl.
*H04S 7/00* (2006.01)
*G10L 19/00* (2013.01)
(Continued)

(52) U.S. Cl.
CPC ..... *H04S 7/306* (2013.01); *G10L 19/00* (2013.01); *G10L 19/008* (2013.01);
(Continued)

(58) Field of Classification Search
CPC . H04S 7/306; H04S 1/005; H04S 7/01; H04S 2400/11; H04S 2420/01; H04S 2400/13; H04S 2420/07; H04S 3/002; H04S 2420/03; H04S 2400/15; G10L 19/00; G10L 19/008; G10L 19/018; G10L 19/20
See application file for complete search history.

(56) References Cited

U.S. PATENT DOCUMENTS 8,682,010 B2 3/2014 Macours
2003/0007648 A1 1/2003 Currell
(Continued)

OTHER PUBLICATIONS

"International Application Serial No. PCT/US2017/016248, International Search Report dated Jun. 7, 2017", 4 pgs.
(Continued)

*Primary Examiner* — Sonia Gay
(74) *Attorney, Agent, or Firm* — Schwegman Lundberg & Woessner, P.A.

(57) ABSTRACT

Accurate modeling of acoustic reverberation can be essential to generating and providing a realistic virtual reality or augmented reality experience for a participant. In an example, a reverberation signal for playback using headphones can be provided. The reverberation signal can correspond to a virtual sound source signal originating at a specified location in a local listener environment. Providing the reverberation signal can include, among other things, using information about a reference impulse response from a reference environment and using characteristic information about reverberation decay in a local environment of the participant. Providing the reverberation signal can further include using information about a relationship between a volume of the reference environment and a volume of the local environment of the participant.

20 Claims, 8 Drawing Sheets

(51) Int. Cl.

| | |
|---|---|
| ***G10L 19/08*** | (2013.01) |
| ***G10L 19/018*** | (2013.01) |
| ***G10L 19/20*** | (2013.01) |
| ***H04S 3/00*** | (2006.01) |
| ***G10L 19/008*** | (2013.01) |
| ***H04S 1/00*** | (2006.01) |

(52) U.S. Cl.

CPC ..... *G10L 19/018* (2013.01); *G10L 19/20* (2013.01); *H04S 1/005* (2013.01); *H04S 3/002* (2013.01); *H04S 7/301* (2013.01); *H04S 7/308* (2013.01); *H04S 2400/11* (2013.01); *H04S 2400/15* (2013.01); *H04S 2420/01* (2013.01); *H04S 2420/03* (2013.01); *H04S 2420/07* (2013.01)

(56) References Cited

U.S. PATENT DOCUMENTS

2011/0268281 A1 11/2011 Florencio et al.
2013/0010975 A1 1/2013 Tsingos et al.
2013/0251168 A1 9/2013 Takazawa
2013/0272527 A1 10/2013 Oomen et al.
2016/0088417 A1* 3/2016 Kim ..... G02B 27/017 381/17

OTHER PUBLICATIONS

"International Application Serial No. PCT/US2017/016248, Invitation to Pay Add'l Fees and Parital Search Report dated Apr. 4, 2017", 2 pgs.

"International Application Serial No. PCT/US2017/016248, Written Opinion dated Jun. 7, 2017", 4 pgs.

Harma, Aki, et al., "Techniques and applications of wearable augmented reality audio", Audio Engineering Society Convention Paper 5768—Present at the 114th Convention, (Mar. 2003), 20 pgs.

Jot, Jean-Marc, et al., "Analysis and Synthesis of Room Reverberation Based on a Statistical Time-Frequency Model", Presented at the 103rd AES Convention,, (Sep. 1997), 43 pgs.

* cited by examiner

AUGMENTED REALITY HEADPHONE ENVIRONMENT RENDERING

CLAIM OF PRIORITY

This patent application claims the benefit of priority to U.S. Application No. 62/290,394, filed on Feb. 2, 2016, and to U.S. Application No. 62/395,882, filed on Sep. 16, 2016, each of which is incorporated by reference herein in its entirety.

BACKGROUND

Audio signal reproduction has evolved beyond simple stereo, or dual-channel, configurations or system. For example, surround sound systems, such as 5.1 surround sound, are commonly used in in-home and commercial installations. Such systems employ loudspeakers at various locations relative to an expected listener, and are configured to provide a more immersive experience for the listener than is available from a conventional stereo configuration.

Some audio signal reproduction systems are configured to deliver three dimensional audio, or 3D audio. In 3D audio, sounds are produced by stereo speakers, surround-sound speakers, speaker-arrays, or headphones or earphones, and can involve or include virtual placement of a sound source in a real or theoretical three-dimensional space auditorily perceived by the listener. For example, virtualized sounds can be provided above, below, or even behind a listener who hears 3D audio-processed sounds.

Conventional stereo audio reproduction via headphones tends to provide sounds that are perceived as originating or emanating from inside a listener's head. In an example, audio signals delivered by headphones, including using a conventional stereo pair of loudspeaker drivers, can be specially processed to achieve 3D audio effects, such as to provide a listener with a perceived spatial sound environment. A 3D audio headphone system can be used for virtual reality applications, such as to provide a listener with a perception of a sound source at a particular position in a local or virtual environment where no real sound source exists. In an example, a 3D audio headphone system can be used for augmented reality applications, such as to provide a listener with a perception of a sound source at a position where no real sound source exists, and yet in a manner that the listener remains at least partially aware of one or more real sounds in the local environment.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter in any way.

Computer-generated audio rendering for virtual reality (VR) or augmented reality (AR) can leverage signal processing technology developments in gaming and virtual reality audio rendering systems and application programming interfaces, such as building upon and extending from prior developments in the fields of computer music and architectural acoustics. Various binaural techniques, artificial reverberation, physical room acoustic modeling, and auralization techniques can be applied to provide users with enhanced listening experiences. In an example, VR or AR audio can be delivered to a listener via headphones or earphones. A VR or AR signal processing system can be configured to reproduce some sounds such that they are perceived by a listener to be emanating from an external source in a local environment rather than from the headphones or from a location inside the listener's head.

Compared to VR 3D audio, AR audio involves the additional challenge of encouraging suspension of a participant's disbelief, such as by providing simulated environment acoustics and source-environment interactions that are substantially consistent with acoustics of a local listening environment. That is, the present inventors have recognized that a problem to be solved includes providing audio signal processing for virtual or added signals in such a manner that the signals include or represent the user's environment, and such that the signals are not readily discriminable from other sounds naturally occurring or reproduced over loudspeakers in the environment. An example can include a rendering of a virtual sound source configured to simulate a "double" of a physically present sound source. The example can include, for instance, a duet between a real performer and a virtual performer playing the same instrument, or a conversation between a real character and his/her "virtual twin" in a given environment.

In an example, a solution to the problem of providing accurate sound sources in a virtual sound field can include matching and applying reverberation decay times, reverberation loudness characteristics, and/or reverberation equalization characteristics (e.g., spectral content of the reverberation) for a given listening environment. The present inventors have recognized that a further solution can include or use measured binaural room impulse responses (BRIRs) or impulse responses calculated from physical or geometric data about an environment. In an example, the solution can include or use measuring a reverberation time in an environment, such as in multiple frequency bands, and can further include or use information about an environment (or room) volume.

In audio-visual augmented reality applications, computer-generated audio objects can be rendered via acoustically transparent headphones to blend with a physical environment heard naturally by the viewer/listener. Such blending can include or use binaural artificial reverberation processing to match or approximate local environment acoustics. When artificial audio objects are appropriately processed, the audio objects may not be discriminable by the listener from other sounds occurring naturally or reproduced over loudspeakers in the environment.

Approaches involving the measurement or calculation of binaural room impulse responses in consumer environments can be limited by practical obstacles and complexity. The present inventors have recognized that a solution to the above-described problem can include using a statistical reverberation model that enables a compact reverberation fingerprint that can be used to characterize an environment. The solution can further include or use computationally efficient, data-driven reverberation rendering for multiple virtual sound sources. The solution can, in an example, be applied to headphone-based "audio-augmented reality" to facilitate natural-sounding, externalized virtual 3D audio reproduction of music, movie or game soundtracks, navigation guides, alerts, or other audio signal content.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

BRIEF DESCRIPTION OF THE DRAWINGS

Referring now to the drawings in which like reference numbers represent corresponding parts throughout.

DETAILED DESCRIPTION

Figure 1:
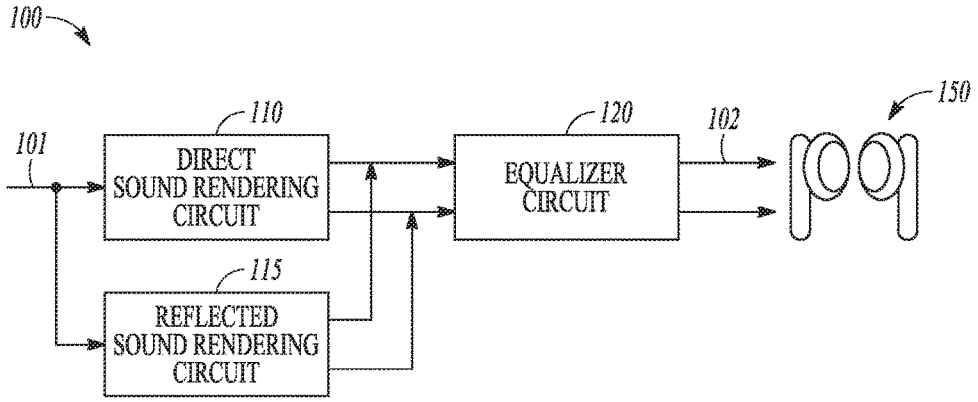
FIG. 1 illustrates generally an example of a signal processing and reproduction system for virtual sound source rendering.

In the following description that includes examples of environment rendering and audio signal processing, such as for reproduction via headphones, reference is made to the accompanying drawings. The drawings show by way of illustration specific examples of how embodiments of the systems and methods can be practiced. It is to be understood that other embodiments can be used and structural changes can be made without departing from the scope of the claimed subject matter.

The present inventors have recognized, among other things, the importance of providing perceptually plausible local audio environment reverberation modeling in virtual reality (VR) and augmented reality (AR) systems. The following discussion includes, among other things, a practical and efficient approach for extending 3D audio rendering algorithms to faithfully match, or approximate, local environment acoustics. Matching or approximating local environment acoustics can include using information about a local environment room volume, using information about intrinsic properties of one or more sources in the local environment, and/or using measured information about a reverberation characteristic in the local environment.

In an example, such as in AR systems, natural-sounding, externalized 3D audio reproduction can use binaural artificial reverberation processing to help match or approximate local environment acoustics. When performed properly, the environment matching yields a listening experience wherein processed sounds are not discriminable from sounds occurring naturally or reproduced over loudspeakers in the environment. In an example, some signal processing techniques for rendering audio content with artificial reverberation processing include or use a measurement or calculation of binaural room impulse responses. In an example, the signal processing techniques can include or use a statistical reverberation model, such as including a "reverberation fingerprint", to characterize a local environment and to provide computationally efficient artificial reverberation. In an example, the techniques include a method that can apply to audio-visual augmented reality applications, such as where computer-generated audio objects are rendered via acoustically transparent headphones to seamlessly blend with a real, physical environment experienced naturally by a viewer or listener.

Audio signal reproduction, such as by loudspeakers or headphones, can use or rely on various acoustic model properties to accurately reproduce sound signals. In an example, different model properties can be used for different scene representations or circumstances, or for simulating a sound source by processing an audio signal according to a specified environment. In an example, a measured binaural room impulse response, or BRIR, can be employed to convolve a source signal and can be represented or modeled by temporal decomposition, such as to identify one or more of a direct sound, early reflections, and late reverberation. However, determining or acquiring BRIRs can be difficult or impractical in consumer applications, such as because consumers may not have the hardware or technical expertise to properly measure such responses.

In an example, a practical approach to characterizing local environment or room reverberation characteristics, such as for use in 3D audio applications like VR and AR, can include or use a reverberation fingerprint that can be substantially independent of a source and/or listener position or orientation. The reverberation fingerprint can be used to provide natural-sounding, virtual multi-channel audio program presentations over headphones. In an example, such presentations can be customized using information about a virtual loudspeaker layout or about one or more acoustic properties of the virtual loudspeakers, sounds sources or other items in an environment.

In an example, an earphone or headphone device can include, or can be coupled to, a virtualizer that is configured to process one or more audio signals and deliver realistic, 3D audio to a listener. The virtualizer can include one or more circuits for rendering, equalizing, balancing, spectrally processing, or otherwise adjusting audio signals to create a particular auditory experience. In an example, the virtualizer can include or use reverberation information to help process the audio signals, such as to simulate different listening environments for the listener. In an example, the earphone or headphone device can include or use a circuit for measuring an environment reverberation characteristic, such as using a transducer integrated with, or in data communication with, the headphone device. The measured reverberation characteristic can be used, such as together with information about a physical layout or volume of an environment, to update the virtualizer to better match a particular environment. In an example, a reverberation measurement circuit can be configured to automatically update a measured reverberation characteristic, such as periodically or in response to an input indicating a change in a listener's position or a change in a local environment.

FIG. 1 illustrates generally an example of a signal processing and reproduction system 100 for virtual sound source rendering. The signal processing and reproduction system 100 includes a direct sound rendering circuit 110, a reflected sound rendering circuit 115, and an equalizer circuit 120. In an example, an audio input signal 101, such as a single-channel or multiple-channel audio signal, or audio object signal, can be provided to one or more of the direct sound rendering circuit 110 and the reflected sound rendering circuit 115, such as via an audio input circuit that is configured to receive a virtual sound source signal. The audio input signal 101 can include acoustic information to be virtualized or rendered via headphones for a listener. For example, the audio input signal 101 can be a virtual sound source signal intended to be perceived by a listener as being located at a specified location, or as originating from a specified location, in the listener's local environment.

In an example, headphones 150 (sometimes referred to herein as earphones) are coupled to the equalizer circuit 120 and receive one or more rendered and equalized audio signals from the equalizer circuit 120. An audio signal amplifier circuit can be further provided in the signal chain to drive the headphones 150. In an example, the headphones 150 are configured to provide to a user substantially acoustically transparent perception of a local sound field, such as corresponding to an environment in which a user of the headphones 150 is located. In other words, sounds originating in the local sound field, such as near the user, can be substantially accurately detected by the user of the headphones 150 even when the user is wearing the headphones 150.

Figure 2:
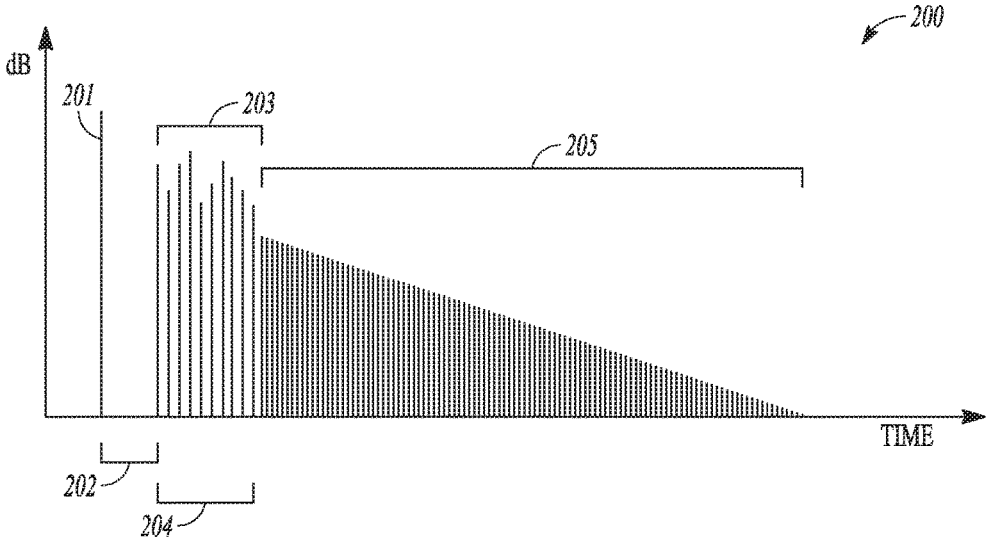
FIG. 2 illustrates generally an example of chart that shows decomposition of a room impulse response model.

In an example, the signal processing schematic 100 represents a signal processing model for rendering a virtual point source and equalizing a headphone transfer function. A synthetic BRIR implemented by the renderer can be decomposed into direct sound, early reflections and late reverberation, as represented in FIG. 2.

In an example, the direct sound rendering circuit 110 and the reflected sound rendering circuit 115 are configured to receive a digital audio signal, corresponding to the audio input signal 101, and the digital audio signal can include encoded information about one or more of a reference environment, a reference impulse response (e.g., including information about a reference sound and a reference receiver in the reference environment), or a local listener environment, such as including volume information about the reference environment and the local listener environment. The direct sound rendering circuit 110 and the reflected sound rendering circuit 115 can use the encoded information to process the audio input signal 101, or to generate a new signal corresponding to an artificial direct or reflected component of the audio input signal 101. In an example, the direct sound rendering circuit 110 and the reflected sound rendering circuit 115 include respective data inputs configured to receive the information about the reference environment, reference impulse response (e.g., including information about a reference sound and a reference receiver in the reference environment), or local listener environment, such as including volume information about the reference environment and the local listener environment.

The direct sound rendering circuit 110 can be configured to provide a direct sound signal based on the audio input signal 101. The direct sound rendering circuit 110 can, for example, apply head-related transfer functions (HRTFs), volume adjustments, panning adjustment, spectral shaping, or other filters or processing to position or locate the audio input signal 101 in a virtual environment. In an example that includes the headphones 150 configured such that they are substantially acoustically transparent, such as for augmented reality applications, the virtual environment can correspond to a local environment of a listener or participant wearing the headphones 150, and the direct sound rendering circuit 110 provides a direct sound signal corresponding to an origination location of the source in the local environment.

The reflected sound rendering circuit 115 can be configured to provide a reverberation signal based on the audio input signal 101 and based on one or more characteristics of the local environment. For example, the reflected sound rendering circuit 115 can include a reverberation signal processor circuit configured to generate a reverberation signal corresponding to the audio input signal 101 (e.g., a virtual sound source signal) if the audio input signal 101 was an actual sound originating at a specified location in the local environment of a listener (e.g., a listener using the headphones 150). For example, the reflected sound rendering circuit 115 can be configured to use information about a reference impulse response, information about a reference room volume corresponding to the reference impulse response, and information about a room volume of the listener's local environment, to generate a reverberation signal based on the audio input signal 101. In an example, the reflected sound rendering circuit 115 can be configured to scale a reverberation signal for the audio input signal 101 based on a relationship between the room volumes of the reference and local environments. For example, the reverberation signal can be weighted based on a ratio or other fixed or variable amount based on the environment volumes.

FIG. 2 illustrates generally an example of a chart 200 that shows decomposition of a room impulse response (RIR) model for a sound source and a receiver (e.g., a listener or microphone) located in a room. The chart 200 shows multiple temporally consecutive sections, including a direct sound 201, early reflections 203, and late reverberation 205. The direct sound 201 section represents a direct acoustic path from a sound source to a receiver. Following the direct sound 201, the chart 200 shows a reflections delay 202. The reflections delay 202 corresponds to a duration between a direct sound arrival at the receiver and a first environment reflection of the acoustic signal emitted by the sound source. Following the reflections delay 202, the chart 200 shows a series of early reflections 203 corresponding to one or more environment-related audio signal reflections. Following the early reflections 203, later-arriving reflections form the late reverberation 205. The reverberation delay 204 interval represents a start time of the late reverberation 205 relative to a start time of the early reflections 203. Late reverberation signal power decays exponentially with time in the RIR, and its decay rate can be measured by the reverberation decay time, which varies with frequency.

Table 1 describes objective acoustic and geometric parameters that characterize each section in the RIR model shown in the chart 200. Table 1 further distinguishes parameters intrinsic to the source, the listener (or receiver) or the environment (or room). For late reverberation effects in a room or local environment, reverberation decay rate and the room's volume are important factors. For example, Table 1 shows that environment-specific parameters that are sufficient in order to characterize Late Reverberation in an environment, regardless of source and listener positions or properties, include the environment's volume and its reverberation decay time or decay rate.

TABLE 1

Overview of RIR model acoustic and geometric parameters.

| | Direct sound | Early reflections | Late Reverberation |
|---|---|---|---|
| Source | Free-field transfer functions Relative distance and orientation | Free-field transfer functions Absolute position and orientation | Diffuse-field transfer function Relative distance |
| Listener | Free-field head-related transfer functions Relative orientation | Free-field head-related transfer functions Absolute position and orientation | Diffuse-field head-related transfer functions and inter-aural correlation coefficient |
| Environment | Air absorption | Air absorption Boundary geometry and material properties | Reverberation Decay Time Cubic volume |

In an example, in the absence of obstruction by intervening acoustic obstacles, direct sound propagation can be substantially independent of environment parameters other than those affecting propagation time, velocity and absorption in the medium. Such parameters can include, among other things, relative humidity, temperature, a relative distance between a source and listener, or movement of one or both of a source and a listener.

In an example, various data or information can be used to characterize and simulate sound reproduction, radiation, and capture. For example, a sound source and a target listener's ears can be modeled as emitting and receiving transducers, respectively. Each can be characterized by one or more direction-dependent free-field transfer functions, such as including the listener's head-related transfer function, or HRTF, to characterize reception at the listener's ears, such as from a point source in space. In an example, the ear and/or transducer models can further include a frequency-dependent sensitivity characteristic.

Figure 3:
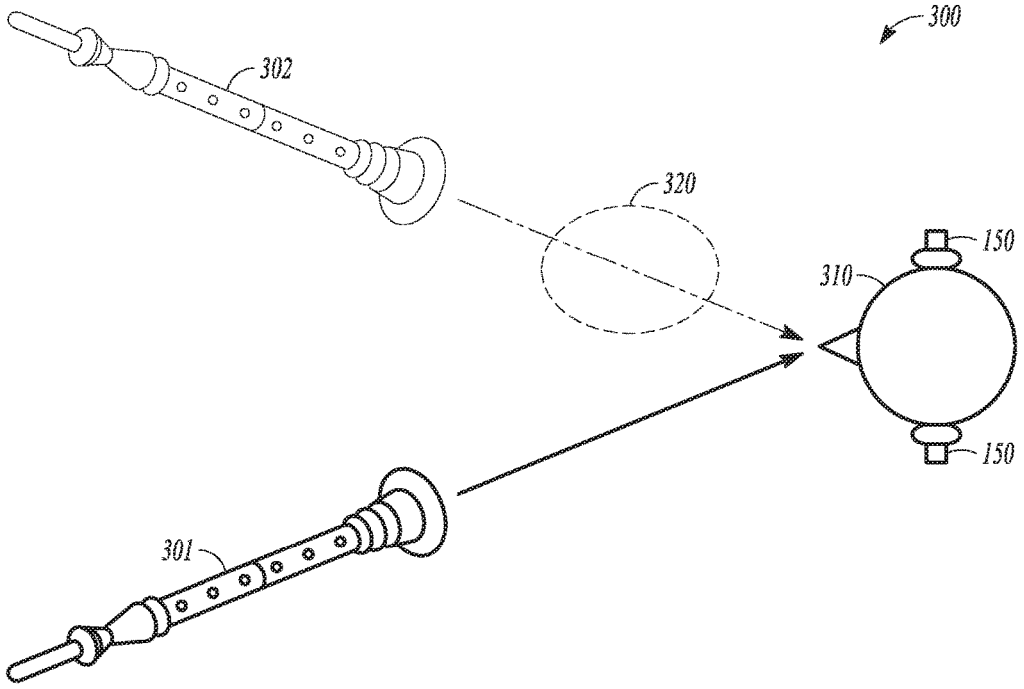
FIG. 3 illustrates generally an example that includes a first sound source, a virtual source, and a listener.

FIG. 3 illustrates generally an example 300 that includes a first sound source 301, a virtual source 302, and a listener 310. The listener 310 can be situated in an environment (e.g., in a small, reverberant room, or in a large outdoor space, etc.) and can use the headphones 150. The headphones 150 can be substantially acoustically transparent such that sounds from the first sound source 301, such as originating from a first location in the listener's environment, can be heard by the listener 310. In an example, the headphones 150, or a signal processing circuit coupled to the headphones 150, can be configured to reproduce sounds from the virtual source 302, such as can be perceived by the listener 310 to be at a different second location in the listener's environment.

In an example, the headphones 150 used by the listener 310 can receive an audio signal from the equalizer circuit 120 from the system 100 of FIG. 1. The equalizer circuit 120 can be configured such that, for any sound source reproduced by the headphones 150, the virtual source 302 is substantially spectrally indistinguishable from the first sound source 301, such as can be heard naturally by the listener 310 through the acoustically transparent headphones 150.

In an example, the environment of the listener 310 can include an obstacle 320, such as can be located in a signal transmission path between the first sound source 301 and the listener 310, or between the virtual source 302 and the listener 310, or both. When such obstacles are present, various sound diffraction and/or transmission models can be used (e.g., by one or more portions of the system 100) to accurately render an audio signal at the headphones 150. In an example, geometric or physical data, such as can be provided to an augmented-reality visual rendering system, can be used by the rendering system, such as can include or use the system 100, to provide audio signals to the headphones 150.

Early reflection modeling by augmented-reality audio rendering systems can depend to a large extent on a desired scale, detail, resolution, or accuracy of a rendered audio signal. In an example, an augmented-reality audio rendering system, such as including all or a portion of the system 100, can attempt to accurately and exhaustively reproduce reflections for each of multiple, virtual sound sources, such as corresponding to respective multiple audio image sources with different positions, orientations and/or spectral content, and each audio image source can be defined at least in part by geometric and acoustic parameters characterizing environment boundaries, source parameters and receiver parameters. In an example, characterization (e.g., measurement and analysis) and corresponding binaural rendering of local reflections for augmented-reality applications can be performed, and can include or use one or more of physical or acoustic imaging sensors, cloud-based environment data, and pre-computation of physical algorithms for modeling acoustic propagation.

The present inventors have recognized that a problem to be solved includes simplifying or expediting such comprehensive signal processing that can be computationally expensive, and can require large amounts of data and processing speed, such as to provide accurate audio signals for augmented-reality applications and/or for other applications where effects of a physical environment are used or considered in providing audio signals to a listener. The present inventors have further recognized that a solution to the problem can include a more practical and scalable system, such as can be realized using lesser detail in one or more reflected sound signal models. Owing to psychoacoustic masking phenomena, perceptual effects of acoustic reflections in typical rooms can be accurately and efficiently approximated by modeling combined contributions from multiple reflected signals having a common source, for example, rather than exhaustively matching individual spatio-temporal parameters and frequency-dependent attenuations for each of multiple reflected signals. The present inventors have further recognized that a solution to the problem of separately modeling behavior of multiple virtual sound sources and then combining the results can include determining and using a reverberation fingerprint, such as can be defined or determined based on physical characteristics of a room, and the reverberation fingerprint can be applied to similarly process, or to batch process, multiple sound sources together, such as using a reverberation processor circuit.

In closed environments (e.g., enclosed rooms like a bedroom) or semi-open environments, a reflected sound field builds up to a mixing time, establishing a diffuse reverberation process that lends itself to a tractable statistical time-frequency model predicting BRIR energy, exponential decay, and interaural cross-correlation.

In such a time-frequency model, a sound source and a receiver can be characterized by their diffuse-field transfer functions. In an example, diffuse-field transfer functions can be derived by power-domain spatial averaging of their respective free-field transfer functions.

The mixing time is commonly estimated in milliseconds by $\sqrt{V}$, the square root of the room volume. In an example, a late reverberation decay for a given room or environment can be modeled using the room's volume and its reverberation decay rate (or reverberation time) as a function of frequency, such as can be sampled in a moderate number of frequency bands (e.g., as few as one or two, typically 5-15 or more depending on processing capacity and desired resolution). Volume and reverberation decay rate can be used to control a computationally efficient and perceptually faithful parametric reverberation processor circuit performing reverberation processing algorithms, such as can be shared or used by multiple sources in a virtual room. In an example, the reverberation processor circuit can be configured to perform reverberation algorithms that can be based on a feedback delay network or can be based on convolution with a synthetic BRIR, such as can be modeled as spectrally-shaped, exponentially decaying noise.

In an example, a practical, low-complexity approach for perceptually plausible rendering can be based on minimal local environment data, such as by adapting a set of BRIRs acquired in a reference environment (e.g., acquired using a reference binaural microphone). The adapting can include correcting a reverberation decay time and/or correcting an offset of the reverberation energy level, for example to simulate the same loudspeaker system and the same reference binaural microphone as used in the reference environment, but transposed in a local listening environment. In an example, the adapting can further include correcting direct sound, reverberation, and early reflection energies, spectral equalization, and/or spatio-temporal distribution, such as including or using particular sound source emission data and one or more head-related transfer functions (HRTFs) associated with a listener.

In an example, a VR and AR simulation with 3D audio effects can include or use dynamic head-tracking to compensate for listener head movement, such as in real time. This method can be extended to simulate intermediate sound source positions in the same reference room, and can include sampling a sound source position and/or a listener position or orientation such as to simulate or account for movement substantially in real time. In an example, the position information can be obtained or determined using one or more location sensors or other data that can be used to determine a source or listener position, such as using a WiFi or Bluetooth signal associated with a source or associated with a listener (e.g., using a signal associated with the headphones 150, or with another mobile device corresponding to the listener).

Measured reference BRIRs can be adapted to different rooms, different listeners, and to one or more arbitrary sound sources, thereby simplifying other techniques that can rely on collecting multiple BRIR measurements in a local listening environment. In an example, diffuse reverberation in a room impulse response h(t) can be modeled as a random signal whose variance follows an exponentially decaying envelope, such as can be independent of the audio signal source and receiver (e.g., listener) positions in the room, and can be characterized by a frequency-dependent decay time Tr(f) and an initial power spectrum P(f).

In an example, the frequency-dependent decay time Tr(f) can be used to match or approximate a room's reverberation characteristics, and can be used to process audio signals to provide a perception of "correct" room acoustics to a listener. In other words, an appropriate frequency-dependent decay time Tr(f) can be selected to help provide consistency between real and synthetic, or virtualized, sound sources, such as in AR applications. To further enhance or improve a correspondence or match between real and virtualized room effects, the energy and spectral equalization of reverberation can be corrected. In an example, this correction can be performed by providing an initial power spectrum of the reverberation that corresponds to a real initial power spectrum. Such an initial power spectrum can be influenced by, among other things, radiation characteristics of the source, such as the source's frequency-dependent directivity. Without such a correction, a virtual sound source can sound noticeably different from its real-world counterpart, such as in terms of timbre coloration and sense of distance from, or proximity to, a listener.

In an example, the initial power spectrum P(f) is proportional to a product of the source and receiver diffuse-field transfer functions, and to a reciprocal of the room's volume V. A diffuse-field transfer function can be calculated or determined using power-domain spatial averaging of a source's (or receiver's) free-field transfer functions. An Energy Decay Relief, EDR(t,f), can be a function of time and frequency, can be used to estimate the model parameters Tr(f) and P(f). In an example, an EDR can correspond to an ensemble average of a time-frequency representation of reverberation decay, such as after interruption of an excitation signal (e.g., a stationary white noise signal). In an example, $EDR(t,f) \approx \int_{\tau=t}^{\tau=+\infty} \rho(t,f)d\tau$, where $\rho(t,f)$ is a short-time Fourier transform of h(t). Linear curve fitting at multiple different frequencies can be used to provide an estimate of the frequency-dependent reverberation decay time Tr(f), such as with a modeled EDR extrapolation back to a time of emission, denoted EDR'(0,f). In an example, the initial power spectrum can be determined as P(f)=EDR'(0,f)/Tr(f).

Figure 4A:
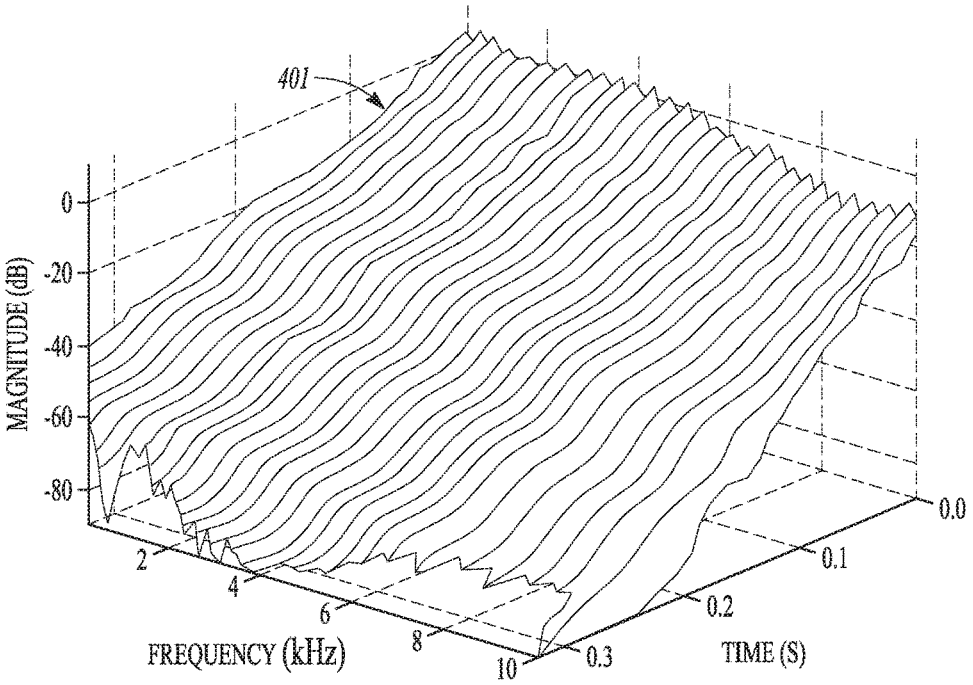
FIG. 4A illustrates generally an example of a measured EDR.
Figure 5A:
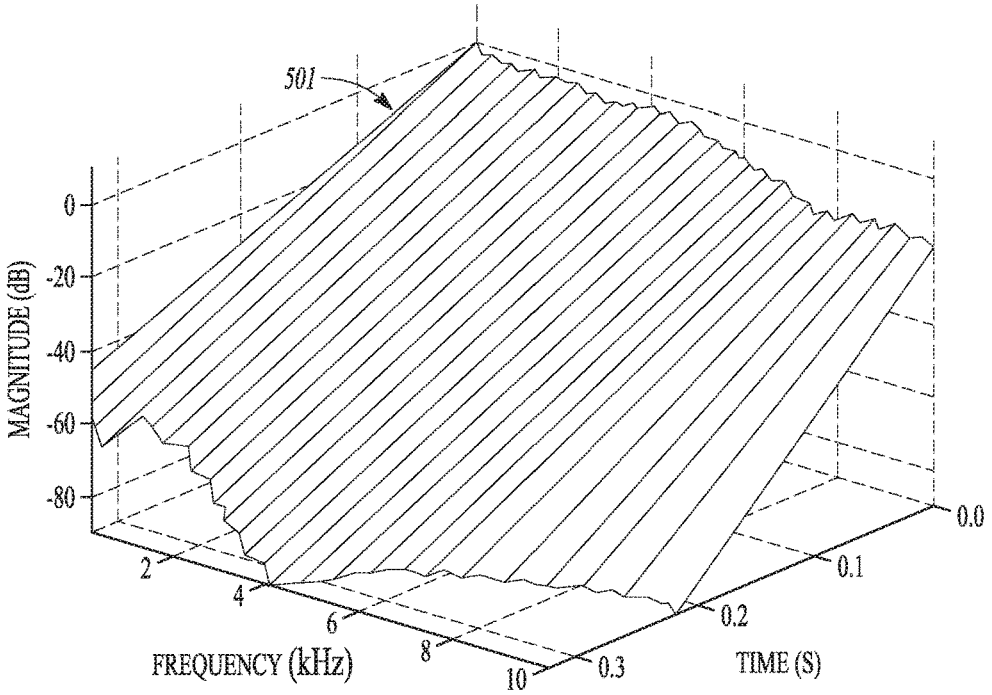
FIG. 5A illustrates generally an example of a modeled EDR.

FIG. 4A illustrates generally an example of a measured energy decay relief (EDR) 401, such as for a reference environment. The measured EDR 401 shows a relationship between relative power of a reverberation decay signal over multiple frequencies and over time. FIG. 5A illustrates generally an example of a modeled EDR 501 for the same reference environment, and using the same axes as the example of FIG. 4A.

The measured EDR 401 in FIG. 4A includes an example of a relative power spectral decay, such as following a white noise signal broadcast to the reference environment. The measured EDR 401 can be derived by backward integration of an impulse response signal power $\rho(t,f)$. Characteristics of the measured EDR 401 can depend at least in part on a position and/or orientation of the source (e.g., the white noise signal source), and can further depend at least in part on a position and/or orientation of the receiver, such as a microphone positioned in the reference environment.

The modeled EDR 501 in FIG. 5A includes an example of a relative power spectral decay, and can be independent of source and receiver positions or orientations. For example, the modeled EDR 501 can be derived by performing linear (or other) fitting and extrapolation of a portion of the measured EDR 401, such as illustrated in FIG. 4B.

Figure 4B:
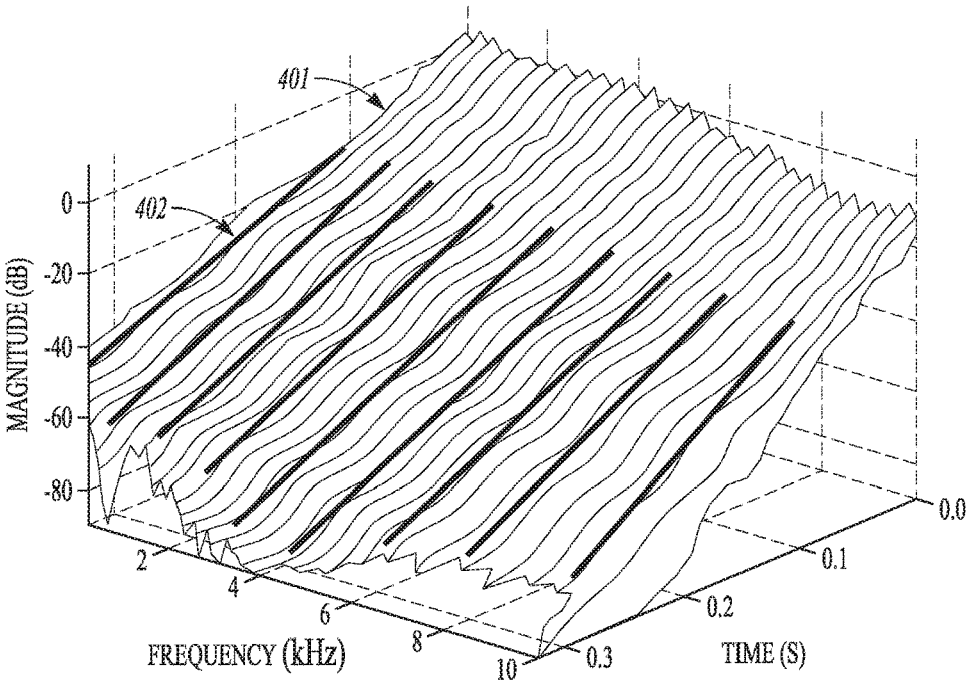
FIG. 4B illustrates generally an example of a measured EDR and multiple frequency-dependent reverberation curves.

FIG. 4B illustrates generally an example of the measured EDR 401 and multiple frequency-dependent reverberation curves 402 fitted to the "surface" of the measured EDR 401. The reverberation curves 402 can be fitted to different or corresponding portions of the measured EDR 401. In the example of FIG. 4B, a first one of the reverberation curves 402 corresponds to a portion of the measured EDR 401 at about 10 kHz and further corresponds to a decay interval between about 0.10 and 0.30 seconds. Another one of the reverberation curves 402 corresponds to a portion of the measured EDR 401 at about 5 kHz and further corresponds to a decay interval between about 0.15 and 0.35 seconds. In an example, the reverberation curves 402 can be fitted to the same decay interval (e.g., between 0.10 and 0.30 seconds) for each of multiple different frequencies.

Referring again to FIG. 5A, the modeled EDR 501 can be determined using the reverberation curves 402. For example, the modeled EDR 501 can include a decay spectrum extrapolated from multiple ones of the reverberation curves 402. For example, one or more of the reverberation curves 402 includes only a segment in the field of the measured EDR 401, and the segment can be extrapolated or extended in the time direction, such as backward to an initial time (e.g., a time zero, or origin time) and/or forward to a final time, such as to a specified lower limit (e.g., −100 dB, etc.). The initial time can correspond to a time of emission of a source signal.

Figure 5B:
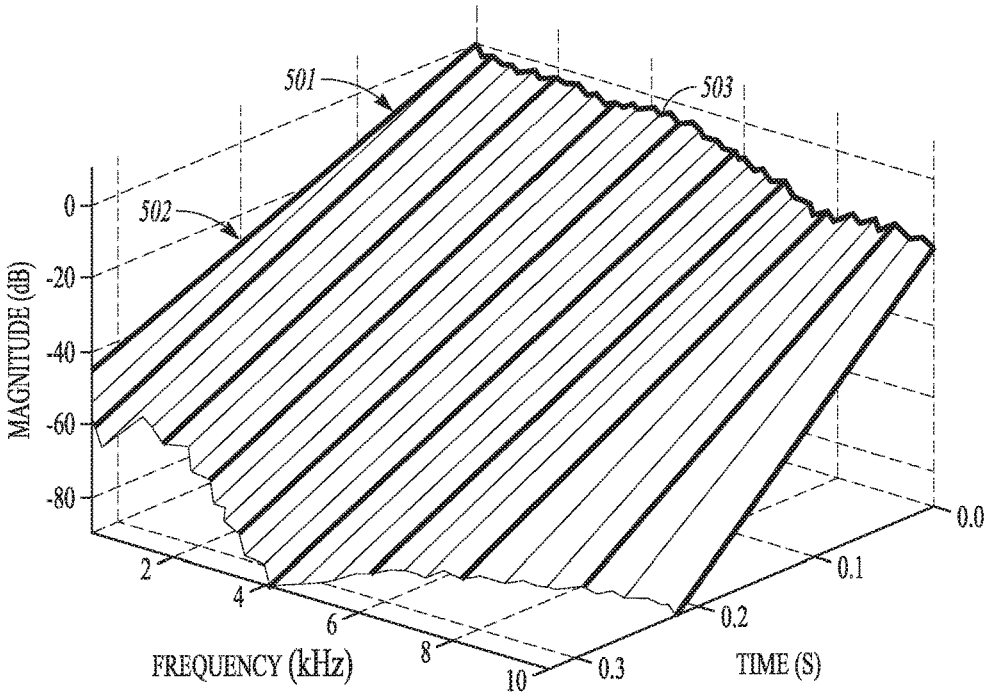
FIG. 5B illustrates generally extrapolated curves corresponding to the reverberation curves of FIG. 5A.

FIG. 5B illustrates generally extrapolated curves 502 corresponding to the reverberation curves 402, and the extrapolated curves 502 can be used to define the modeled EDR 501. In the example of FIG. 5B, an initial power spectrum 503 corresponds to the portion of the modeled EDR 501 at the initial time (e.g., time zero), and is the product of the reverberation decay time and the initial power spectrum at the initial time. That is, the modeled EDR 501 can be characterized by at least a reverberation time Tr(f) and an initial power spectrum P(f). The reverberation time Tr(f) provides a frequency-dependent indication of an expected or modeled reverberation time. The initial power spectrum P(f) includes an indication of a relative power level for a reverberation decay signal, such as relative to some initial power level (e.g., 0 dB), and is frequency-dependent.

In an example, the initial power spectrum P(f) is provided as a product of the reciprocal of a room volume and diffuse-field transfer functions of a signal source and a receiver. This can be convenient for real-time or in-situ audio signal processing for VR and AR, for example, because signals can be processed using static or intrinsic information about a source (e.g., source directivity as a function of frequency, which can be a property that is intrinsic to the source) and room volume information.

A reverberation fingerprint of a room (e.g., the same or other than a reference environment) can include information about a room volume and the reverberation time Tr(f). In other words, a reverberation fingerprint can be determined using sub-band reverberation time information, such as can be derived from a single impulse response measurement. In an example, such a measurement can be performed using consumer-grade microphone and loudspeaker devices, such as including using a microphone associated with a mobile computing device (e.g., a cell phone or smart phone) and home audio loudspeaker that can reproduce a source signal in the environment. In an example, a microphone signal can be monitored, such as substantially in real-time, and a corresponding monitored microphone signal can be used to identify any changes in a local reverberation fingerprint.

In an example, properties of a non-reference sound source and/or listener can be taken into consideration as well. For example, when an actual BRIR is expected to be different from a reference BRIR, then actual loudspeaker response information and/or individual HRTFs can be substituted for free-field and diffuse field transfer functions. Loudspeaker layout can be adjusted in an actual environment, or other direction or distance panning methods can be used for adjusting direct and reflected sounds. In an example, a reverberation processor circuit or other audio processor circuit (e.g., configured to use or apply a feedback delay network, or FDN, reverberation algorithms, etc.) can be shared among multiple virtual sound sources.

Referring again to the example 300 of FIG. 3, the first sound source 301 and the virtual source 302 can be modeled as loudspeakers. A reference BRIR can be measured in a reference environment (e.g., in a reference room), such as using a loudspeaker positioned at the same distance and orientation relative to the receiver or listener 310 as shown in the example 300. FIGS. 6A-6D illustrate an example of using a reference BRIR, or RIR, such as corresponding to a reference environment, to provide a synthesized impulse response corresponding to a listener environment.

Figure 6A:
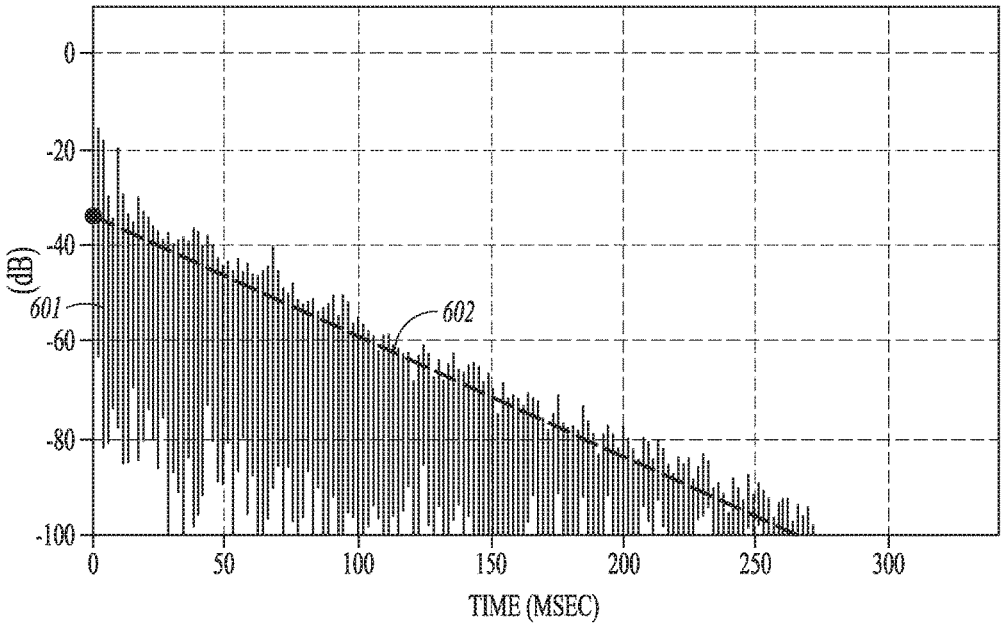
FIG. 6A illustrates generally an example of an impulse response corresponding to a reference environment.

FIG. 6A illustrates generally an example of a measured impulse response 601 corresponding to a reference environment. The example includes a reference decay envelope 602 that can be estimated for a reference impulse response 601. In an example, the reference impulse response 601 corresponds to a response to the first sound source 301 in the reference room.

Figure 6B:
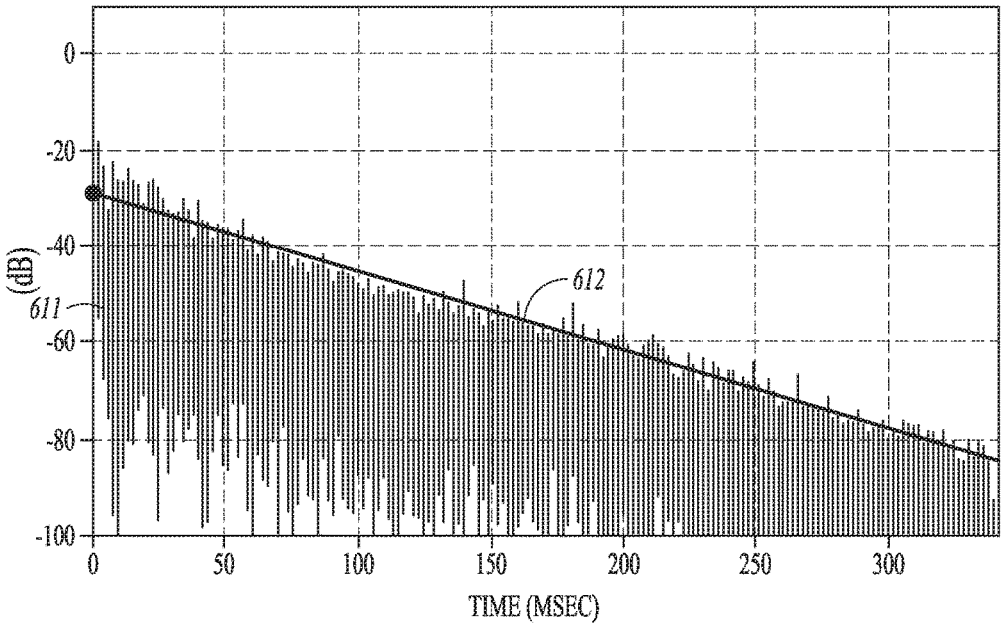
FIG. 6B illustrates generally an example of an impulse response corresponding to a listener environment.

A different, local impulse response can be measured for the same first sound source 301 in the non-reference environment, or local listener environment, such as using the same reference receiver characteristics. FIG. 6B illustrates generally an example of an impulse response corresponding to a listener environment. That is, FIG. 6B includes a local impulse response 611 corresponding to the local environment. A local decay envelope 612 can be estimated for the local impulse response 611. From the examples of FIGS. 6A and 6B, it can be observed that the reference environment, corresponding to FIG. 6A, exhibits faster reverberation decay and less initial power. If a virtual source, such as the virtual source 302, is rendered by convolution with the reference impulse response 601, then a listener may be able to audibly detect incongruity between the audio reproduction and the local environment, which can lead a listener to question whether the virtual source 302 is indeed present in the local environment.

In an example, the reference impulse response 601 can be replaced by an adapted impulse response, such as one whose diffuse reverberation decay envelope better matches or approximates that of a local listener environment, such as without measuring an actual impulse response of the local listener environment. The adapted impulse response can be computationally determined. For example, an initial power spectrum from a reference impulse response (e.g., the reference impulse response 601) can be estimated and then scaled according to a local room volume, for example, according to $P_{local}(f)=P_{ref}(f)V_{ref}/V_{local}$, where $V_{ref}$ is a room volume corresponding to the reference impulse response of the reference environment and $V_{local}$ is a room volume corresponding to the local environment. Additionally, a local environment reverberation decay rate, and its corresponding frequency dependence, can be determined.

Figure 6C:
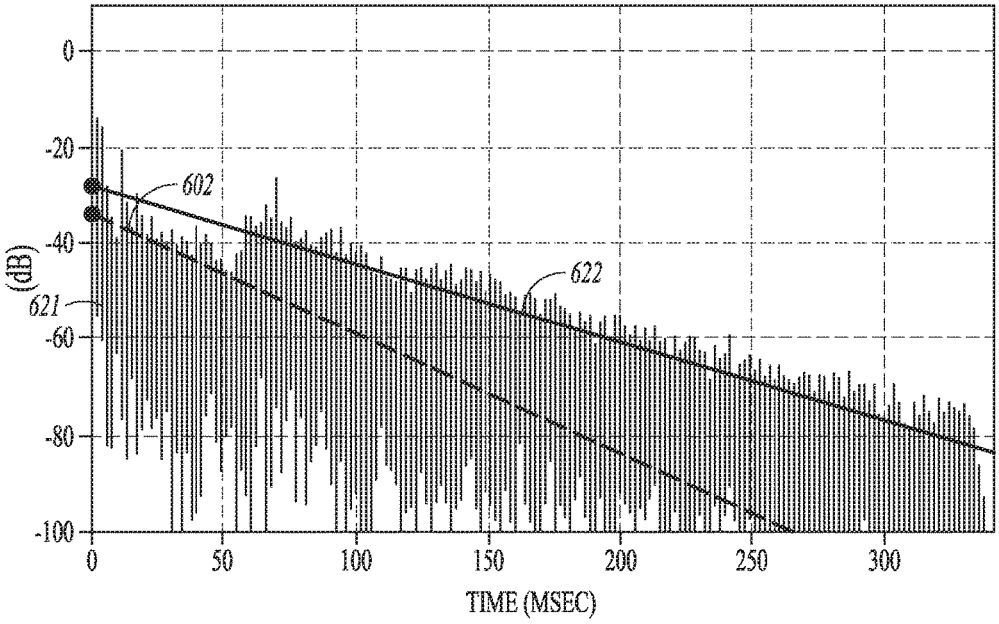
FIG. 6C illustrates generally an example of a first synthesized impulse response corresponding to a listener environment.

FIG. 6C illustrates generally an example of a first synthesized impulse response 621 corresponding to a listener environment. In an example, the first synthesized impulse response 621 can be obtained by modifying the measured impulse response 601 corresponding to the reference environment (see, e.g., FIG. 6A) to match late reverberation properties of the listener environment (see, e.g., the local impulse response 611 corresponding to the local environment of FIG. 6B). The example of FIG. 6C includes a second local decay envelope 622, such as can be equal to the local decay envelope 612 from the example of FIG. 6B, and the reference decay envelope 602 from the example of FIG. 6A.

In the example of FIG. 6C, the second local decay envelope 622 corresponds to a late reverberation portion of the response. It can be accurately rendered by truncating the reference impulse response and implementing a parametric binaural reverberator to simulate the late reverberation response. In an example, the late reverberation can be rendered by frequency-domain reshaping of a reference BRIR, such as by applying a gain offset at each time and frequency. In an example, the gain offset can be given by a dB difference between the local decay envelope 612 and the reference decay envelope 602.

Figure 6D:
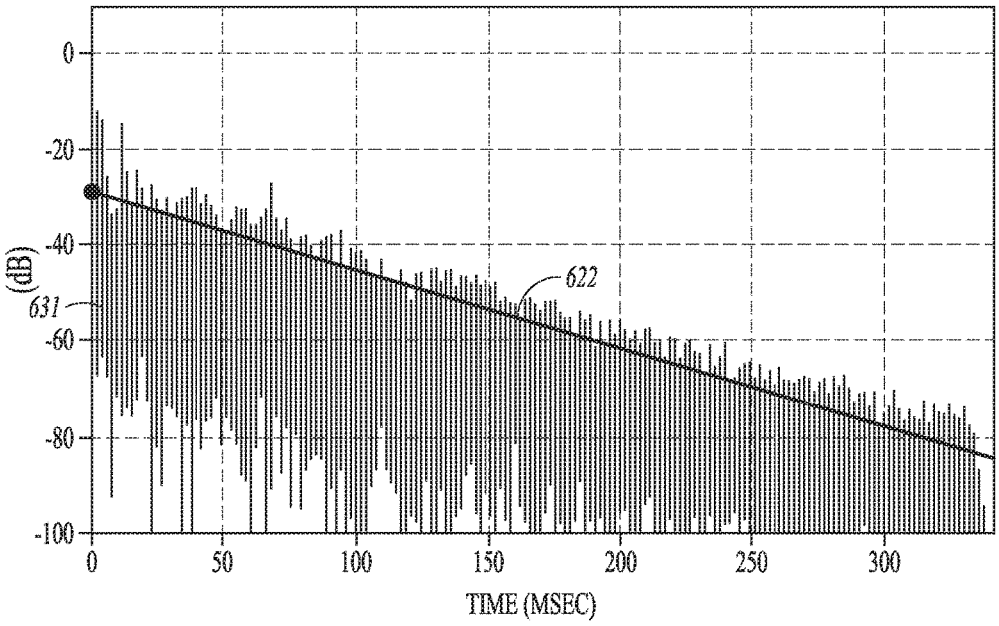
FIG. 6D illustrates generally an example of a second synthesized impulse response, based on the first synthesized impulse response, with modified early reflection characteristics.

In an example, a coarse but useful correction of early reflections in an impulse response can be obtained using the frequency-domain reshaping technique described above. FIG. 6D illustrates generally an example of a second synthesized impulse response 631, based on the first synthesized impulse response 621, with modified early reflection characteristics. In an example, the second synthesized impulse response 631 can be obtained by modifying the first synthesized impulse response 621 from the example of FIG. 6C to match early reflection properties of the listener environment (see, e.g., FIG. 6B).

In an example, a spatio-temporal distribution of individual early reflections in the first synthesized impulse response 621 and the second synthesized impulse response 631 can substantially correspond to early reflections from the reference impulse response 601. That is, notwithstanding actual effects of the environment corresponding to the local impulse response 611, the first synthesized impulse response 621 and the second synthesized impulse response 631 can include early reflection information similar to the reference impulse response 601, such as notwithstanding any differences in environment or room volume, room geometry, or room materials. Additionally, the simulation is facilitated, in this illustration, by an assumption that the virtual source (e.g., the virtual source 302) is identical to the real source (e.g., the first source 301) and is located at the same distance from the listener as in the local BRIR corresponding to the local impulse response 711.

In an example, the above-described model adaptation procedures can be extended to include an arbitrary source and relative orientation and/or directivity, such as including listener-specific HRTF considerations. For a direct sound, this kind of adaptation can include or use spectral equalization based on free-field source and listener transfer functions, such as can be provided for a reference impulse response and for local or specific conditions. Similarly, correction of the late reverberation can be based on source and receiver diffuse-field transfer functions.

In an example, a change in position of a signal source or listener can be accommodated. For example, changes can be made using distance and direction panning techniques. For diffuse reverberation, changes can involve spectral equalization, such as depending on absolute arrival time difference, and can be shaped to match a local reverberation decay rate, such as in a frequency-dependent manner. Such diffuse-field equalizations can be acceptable approximations for early reflections if these are assumed to be uniformly distributed in their directions of emission and arrival. As discussed above, detailed reflection rendering can be driven by in-situ detection of room geometry and recognition of boundary materials. Alternatively, efficient perceptually or statistically motivated models can be used to shift, scale and pan reflection clusters.

Figure 7:
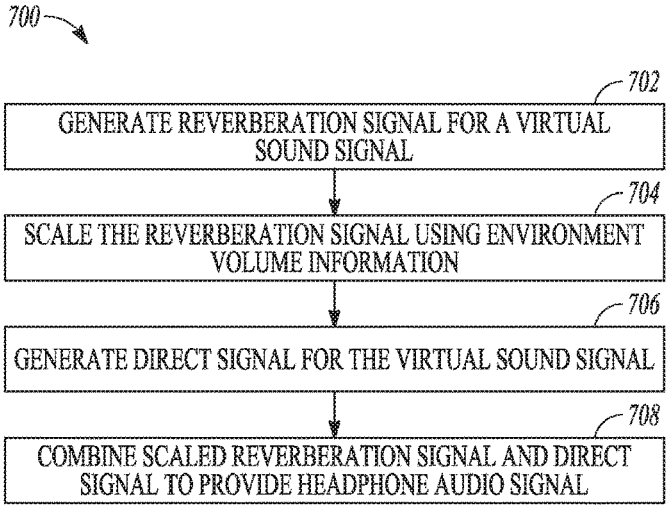
FIG. 7 illustrates generally an example of a method that includes providing a headphone audio signal for a listener in a local listener environment, and the headphone audio signal includes a direct audio signal and a reverberation signal component.

FIG. 7 illustrates generally an example of a method 700 that includes providing a headphone audio signal for a listener in a local listener environment, and the headphone audio signal includes a direct audio signal and a reverberation signal component. At operation 702, the example includes generating a reverberation signal for a virtual sound signal. The reverberation signal can be generated, for example, using the reflected sound rendering circuit 115 from the example of FIG. 1 to process the virtual sound signal (e.g., the audio input signal 101). In an example, the reflected sound rendering circuit 115 can receive information about a reference impulse response (e.g., corresponding to a reference sound source and a reference receiver) in a reference environment, and can receive information about a local reverberation decay time associated with a local listener environment. The reflected sound rendering circuit 115 can then generate the reverberation signal based on the virtual sound signal according to the method illustrated in FIG. 6C or 6D. For example, the reflected sound rendering circuit 115 can modify the reference impulse response to match late reverberation properties of the local listener environment, such as using the received information about the local reverberation decay time. In an example, the modification can include frequency-domain reshaping of the reference impulse response, such as by applying a gain offset at various times and frequencies, and the gain offset can be provided based on a magnitude difference between a decay envelope of the local reverberation decay time and a reference envelope of the reference impulse response. The reflected sound rendering circuit 115 can render the reverberation signal, for example, by convolving the modified impulse response with the virtual sound signal.

At operation 704, the method 700 can include scaling the reverberation signal using environment volume information. In an example, operation 704 includes using the reflected sound rendering circuit 115 to receive room volume information about a local listener environment and to receive room volume information about a reference environment, such as corresponding to the reference impulse response used to generate the reverberation signal at operation 702. Receiving the room volume information can include, among other things, receiving a numerical indication of a room volume, sensing a room volume, or computing or determining a room volume such as using dimensional information about a room from a CAD model or other 2D or 3D drawing. In an example, the reverberation signal can be scaled based on a relationship between the room volume of the local listener environment and the room volume of the reference environment. For example, the reverberation signal can be scaled using a ratio of the local room volume to the reference room volume. Other scaling or corrective factors can be used. In an example, different frequency components of the reverberation signal can be differently scaled, such as using the volume relationship or using other factors.

At operation 706, the example method 700 can include generating a direct signal for the virtual sound signal. Generating the direct signal can include using the direct sound rendering circuit 110 to provide an audio signal, virtually localized in the local listener environment, based on the virtual sound signal. For example, the direct signal can be provided by using the direct sound rendering circuit 110 to apply a head-related transfer function to the virtual sound signal to accommodate a particular listener's unique characteristics. The direct sound rendering circuit 110 can further process the virtual sound signal, such as by adjusting amplitude, panning, spectral shaping or equalization, or through other processing or filtering, to position or locate the virtual sound signal in the listener's local environment.

At operation 708, the method 700 includes combining the scaled reverberation signal from operation 704 with the direct signal generated at operation 706. In an example, the combination is performed by a dedicated audio signal mixer circuit, such as can be included in the example signal processing and reproduction system 100 of FIG. 1. For example, the mixer circuit can be configured to receive the direct signal for the virtual sound signal from the direct sound rendering circuit 110 and can be configured to receive the reverberation signal for the virtual sound signal from the reflected sound rendering circuit 115, and can provide a combined signal to the equalizer circuit 120. In an example, the mixer circuit is included in the equalizer circuit 120. The mixer circuit can optionally be configured to further balance or adjust relative amplitudes or spectral content of the direct signal and the reverberation signal to provide a combined headphone audio signal.

Figure 8:
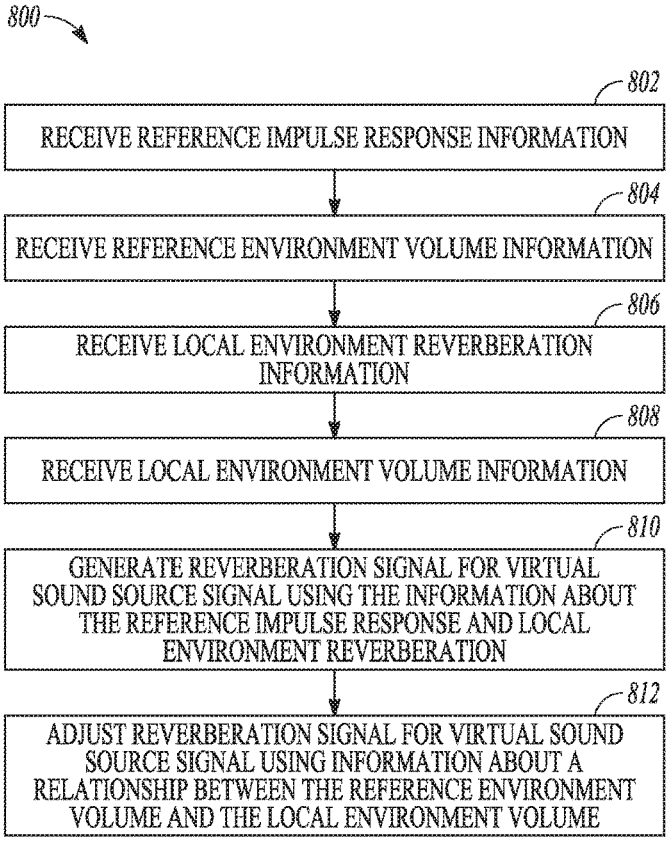
FIG. 8 illustrates generally an example of a method that includes generating a reverberation signal for a virtual sound source.

FIG. 8 illustrates generally an example of a method 800 that includes generating a reverberation signal for a virtual sound source. At operation 802, the example includes receiving reference impulse response information. The reference impulse response information can include impulse response data corresponding to a reference sound source and a reference receiver, such as can be measured in a reference environment. In an example, the reference impulse response information includes information about a diffuse-field and/or free-field transfer function corresponding to one or both of the reference sound source and the reference receiver. For example, the information about the reference impulse response can include information about a head-related transfer function for a listener in the reference environment (e.g., the same listener as is in the local environment). Head-related transfer functions can be specific to a particular user and therefore the reference impulse response information can be changed or updated when a different user or listener participates.

In an example, receiving the reference impulse response information can include receiving information about a diffuse-field transfer function for a local source of the virtual sound source. The reference impulse response can be scaled according to a relationship (e.g., difference, ratio, etc.) between the diffuse-field transfer function for the local source and a diffuse-field transfer function for the reference sound source. Similarly, receiving the reference impulse response information can additionally or alternatively include receiving information about a diffuse-field head-related transfer function for a reference receiver of the reference sound source. The reference impulse response can then be additionally or alternatively scaled according to a relationship (e.g., difference, ratio, etc.) between the diffuse-field head-related transfer function for the local listener and a diffuse-field transfer function for the reference receiver.

At operation 804, the method 800 includes receiving reference environment volume information. The reference environment volume information can include an indication or numerical value associated with a room volume, or can include dimensional information about the reference environment from which room volume can be determined or calculated. In an example, other information about the reference environment such as information about objects in the reference environment or surface finishes can be similarly included.

At operation 806, the method 800 includes receiving local environment reverberation information. Receiving the local environment reverberation information can include using the reflected sound rendering circuit 115 to receive or retrieve previously-acquired or previously-computed data about a local environment. In an example, receiving the local environment reverberation information at operation 806 includes sensing a reverberation decay time in a local listener environment, such as using a general purpose microphone (e.g., on a listener's smart phone, headset, or other device). In an example, the received local environment reverberation information can include frequency information corresponding to the virtual sound source. That is, the virtual sound source can include acoustic frequency content corresponding to a specified frequency band (e.g., 0.4-3 kHz) and the received local environment reverberation information can include reverberation decay information corresponding to at least a portion of the same specified frequency band.

In an example, various frequency binning or grouping schemes can be used for time-frequency information associated with decay times. For example, information about Mel-frequency bands or critical bands can be used, such as additionally or alternatively to using continuous spectrum information about reverberation decay characteristics. In an example, frequency smoothing and/or time smoothing can similarly be used to help stabilize reverberation decay envelope information, such as for reference and local environments.

At operation 808, the method 800 includes receiving local environment volume information. The local environment volume information can include an indication or numerical value associated with a room volume, or can include dimensional information about the local environment from which room volume can be determined or calculated. In an example, other information about the local environment such as information about objects in the local environment or surface finishes can be similarly included.

At operation 810, the method 800 includes generating a reverberation signal for the virtual sound source signal using the information about the reference impulse response from operation 802 and using the local environment reverberation information from operation 806. Generating the reverberation signal at operation 810 can include using the reflected sound rendering circuit 115.

In an example, generating the reverberation signal at operation 810 includes receiving or determining a time-frequency envelope for the reference impulse response information received at operation 802, and then adjusting the time-frequency envelope based on corresponding portions of a time-frequency envelope associated with the local environment reverberation information (e.g., a local reverberation decay time) received at operation 806. That is, adjusting the time-frequency envelope of the reference impulse response can include adjusting the envelope based on a relationship (e.g., a difference, ratio, etc.) between corresponding portions of a time-frequency envelope of the local reverberation decay and the time-frequency envelope associated with the reference impulse response. In an example, the reflected sound rendering circuit 115 can include or use an artificial reverberator circuit that can process the virtual sound source signal using the adjusted envelope to thereby match the local reverberation decay for the local listener environment.

At operation 812, the method 800 includes adjusting the reverberation signal generated at operation 810. For example, operation 812 can include adjusting the reverberation signal using information about a relationship between the reference environment volume (see, e.g., operation 804) and the local environment volume (see, e.g., operation 808), such as using the reflected sound rendering circuit 115 or using another mixer or audio signal scaling circuit. The adjusted reverberation signal from operation 812 can be combined with a direct sound version of the virtual sound source signal and then provided to a listener via headphones.

In an example, operation 812 includes determining a ratio of the local environment volume to the reference environment volume. That is, operation 812 can include determining a room volume associated with the reference environment, such as corresponding to the reference impulse response, and determining a room volume associated with the local listener's environment. The reverberation signal can then be scaled according to a ratio of the room volumes. The scaled reverberation signal can be used in combination with the direct sound and then provided to the listener via headphones.

In an example, operation 812 includes adjusting a late reverberation portion of the reverberation signal (see, e.g., FIG. 2 at late reverberation 205). An early reverberation portion of the reverberation signal can be similarly but differently adjusted. For example, the early reverberation portion of the reverberation signal can be adjusted using the reference impulse response, rather than the adjusted impulse response. That is, in an example, the adjusted reverberation signal can include a first portion (corresponding to early reverberation or early reflections) that is based on the reference impulse response signal, and can include a subsequent second portion (corresponding to late reverberation) that is based on the adjusted reference impulse response.

Figure 9:
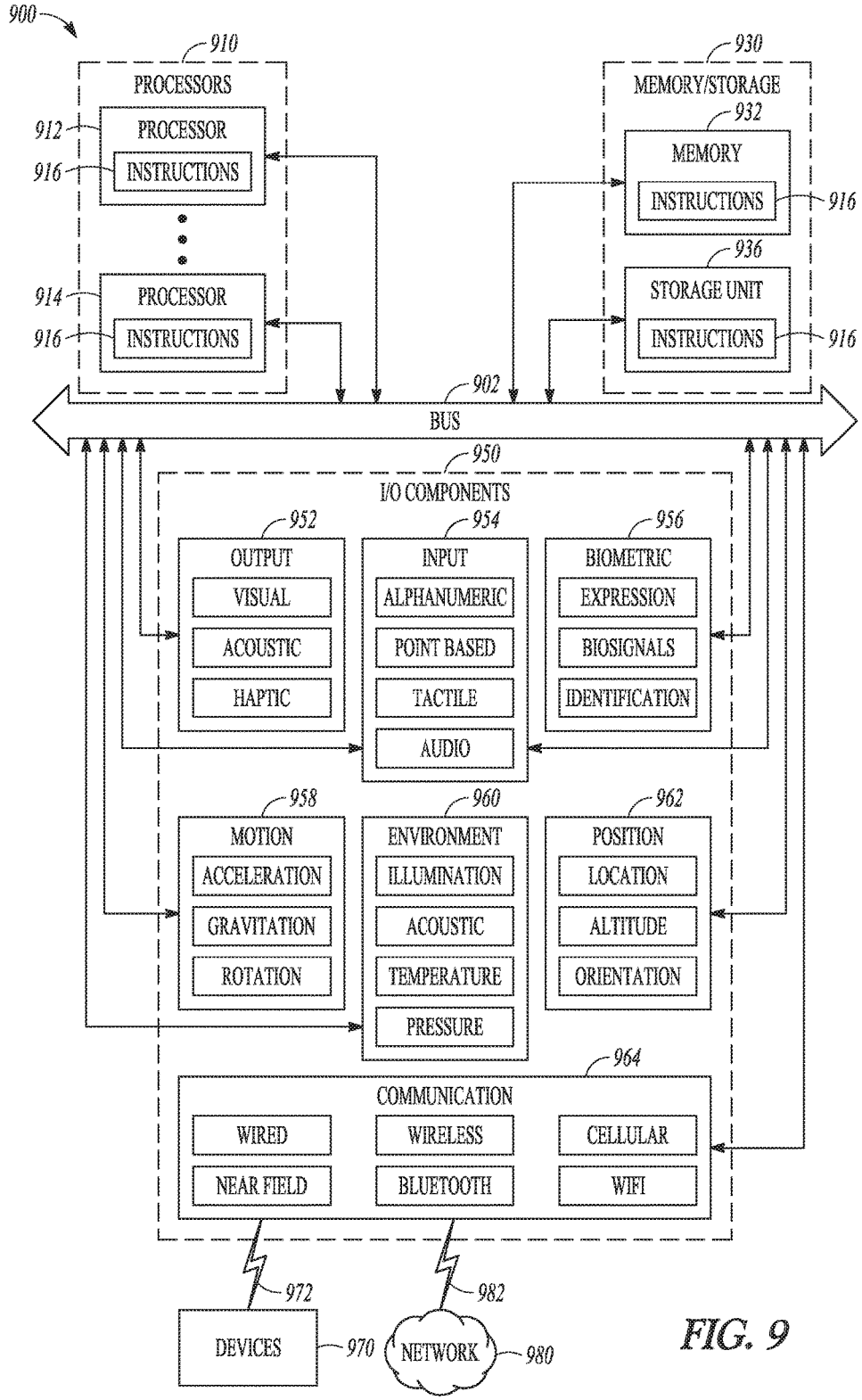
FIG. 9 is a block diagram illustrating components of a machine, according to some example embodiments, able to read instructions from a machine-readable medium (e.g., a machine-readable storage medium) and perform any one or more of the methodologies discussed herein.

FIG. 9 is a block diagram illustrating components of a machine 900, according to some example embodiments, able to read instructions 916 from a machine-readable medium (e.g., a machine-readable storage medium) and perform any one or more of the methodologies discussed herein. Specifically, FIG. 9 shows a diagrammatic representation of the machine 900 in the example form of a computer system, within which the instructions 916 (e.g., software, a program, an application, an applet, an app, or other executable code) for causing the machine 900 to perform any one or more of the methodologies discussed herein may be executed. For example, the instructions 916 can implement modules of FIG. 1, and so forth. The instructions 916 transform the general, non-programmed machine 900 into a particular machine programmed to carry out the described and illustrated functions in the manner described. In alternative embodiments, the machine 900 operates as a standalone device or can be coupled (e.g., networked) to other machines. In a networked deployment, the machine 900 can operate in the capacity of a server machine or a client machine in a server-client network environment, or as a peer machine in a peer-to-peer (or distributed) network environment.

The machine 900 can comprise, but is not limited to, a server computer, a client computer, a personal computer (PC), a tablet computer, a laptop computer, a netbook, a set-top box (STB), a personal digital assistant (PDA), an entertainment media system, a cellular telephone, a smart phone, a mobile device, a wearable device (e.g., a smart watch), a smart home device (e.g., a smart appliance), other smart devices, a web appliance, a network router, a network switch, a network bridge, a headphone driver, or any machine capable of executing the instructions 916, sequentially or otherwise, that specify actions to be taken by the machine 900. Further, while only a single machine 900 is illustrated, the term "machine" shall also be taken to include a collection of machines 900 that individually or jointly execute the instructions 916 to perform any one or more of the methodologies discussed herein.

The machine 900 can include processors 910, memory/storage 930, and I/O components 950, which can be configured to communicate with each other such as via a bus 902. In an example embodiment, the processors 910 (e.g., a central processing unit (CPU), a reduced instruction set computing (RISC) processor, a complex instruction set computing (CISC) processor, a graphics processing unit (GPU), a digital signal processor (DSP), an ASIC, a radio-frequency integrated circuit (RFIC), another processor, or any suitable combination thereof) can include, for example, a circuit such as a processor 912 and a processor 914 that may execute the instructions 916. The term "processor" is intended to include a multi-core processor 912, 914 that can comprise two or more independent processors 912, 914 (sometimes referred to as "cores") that may execute the instructions 916 contemporaneously. Although FIG. 9 shows multiple processors 910, the machine 900 may include a single processor 912, 914 with a single core, a single processor 912, 914 with multiple cores (e.g., a multi-core processor 912, 914), multiple processors 912, 914 with a single core, multiple processors 912, 914 with multiples cores, or any combination thereof.

The memory/storage 930 can include a memory 932, such as a main memory circuit, or other memory storage circuit, and a storage unit 936, both accessible to the processors 910 such as via the bus 902. The storage unit 936 and memory 932 store the instructions 916 embodying any one or more of the methodologies or functions described herein. The instructions 916 may also reside, completely or partially, within the memory 932, within the storage unit 936, within at least one of the processors 910 (e.g., within the cache memory of processor 912, 914), or any suitable combination thereof, during execution thereof by the machine 900. Accordingly, the memory 932, the storage unit 936, and the memory of the processors 910 are examples of machine-readable media.

As used herein, "machine-readable medium" means a device able to store the instructions 916 and data temporarily or permanently and may include, but not be limited to, random-access memory (RAM), read-only memory (ROM), buffer memory, flash memory, optical media, magnetic media, cache memory, other types of storage (e.g., erasable programmable read-only memory (EEPROM)), and/or any suitable combination thereof. The term "machine-readable medium" should be taken to include a single medium or multiple media (e.g., a centralized or distributed database, or associated caches and servers) able to store the instructions 916. The term "machine-readable medium" shall also be taken to include any medium, or combination of multiple media, that is capable of storing instructions (e.g., instructions 916) for execution by a machine (e.g., machine 900), such that the instructions 916, when executed by one or more processors of the machine 900 (e.g., processors 910), cause the machine 900 to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 950 may include a wide variety of components to receive input, provide output, produce output, transmit information, exchange information, capture measurements, and so on. The specific I/O components 950 that are included in a particular machine 900 will depend on the type of machine 900. For example, portable machines such as mobile phones will likely include a touch input device or other such input mechanisms, while a headless server machine will likely not include such a touch input device. It will be appreciated that the I/O components 950 may include many other components that are not shown in FIG. 9. The I/O components 950 are grouped by functionality merely for simplifying the following discussion, and the grouping is in no way limiting. In various example embodiments, the I/O components 950 may include output components 952 and input components 954. The output components 952 can include visual components (e.g., a display such as a plasma display panel (PDP), a light emitting diode (LED) display, a liquid crystal display (LCD), a projector, or a cathode ray tube (CRT)), acoustic components (e.g., speakers), haptic components (e.g., a vibratory motor, resistance mechanisms), other signal generators, and so forth. The input components 954 can include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or other pointing instruments), tactile input components (e.g., a physical button, a touch screen that provides location and/or force of touches or touch gestures, or other tactile input components), audio input components (e.g., a microphone), and the like.

In further example embodiments, the I/O components 950 can include biometric components 956, motion components 958, environmental components 960, or position components 962, among a wide array of other components. For example, the biometric components 956 can include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram based identification), and the like, such as can influence a inclusion, use, or selection of a listener-specific or environment-specific impulse response or HRTF, for example. The motion components 958 can include acceleration sensor components (e.g., accelerometer), gravitation sensor components, rotation sensor components (e.g., gyroscope), and so forth. The environmental components 960 can include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect reverberation decay times, such as for one or more frequencies or frequency bands), proximity sensor or room volume sensing components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 962 can include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication can be implemented using a wide variety of technologies. The I/O components 950 can include communication components 964 operable to couple the machine 900 to a network 980 or devices 970 via a coupling 982 and a coupling 972 respectively. For example, the communication components 964 can include a network interface component or other suitable device to interface with the network 980. In further examples, the communication components 964 can include wired communication components, wireless communication components, cellular communication components, near field communication (NFC) components, Bluetooth® components (e.g., Bluetooth® Low Energy), Wi-Fi® components, and other communication components to provide communication via other modalities. The devices 970 can be another machine or any of a wide variety of peripheral devices (e.g., a peripheral device coupled via a USB).

Moreover, the communication components 964 can detect identifiers or include components operable to detect identifiers. For example, the communication components 964 can include radio frequency identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF49, Ultra Code, UCC RSS-2D bar code, and other optical codes), or acoustic detection components (e.g., microphones to identify tagged audio signals). In addition, a variety of information can be derived via the communication components 964, such as location via Internet Protocol (IP) geolocation, location via Wi-Fi® signal triangulation, location via detecting an NFC beacon signal that may indicate a particular location, and so forth. Such identifiers can be used to determine information about one or more of a reference or local impulse response, reference or local environment characteristic, or a listener-specific characteristic.

In various example embodiments, one or more portions of the network 980 can be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the public switched telephone network (PSTN), a plain old telephone service (POTS) network, a cellular telephone network, a wireless network, a Wi-Fi® network, another type of network, or a combination of two or more such networks. For example, the network 980 or a portion of the network 980 can include a wireless or cellular network and the coupling 982 may be a Code Division Multiple Access (CDMA) connection, a Global System for Mobile communications (GSM) connection, or another type of cellular or wireless coupling. In this example, the coupling 982 can implement any of a variety of types of data transfer technology, such as Single Carrier Radio Transmission Technology (1×RTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology. In an example, such a wireless communication protocol or network can be configured to transmit headphone audio signals from a centralized processor or machine to a headphone device in use by a listener.

The instructions 916 can be transmitted or received over the network 980 using a transmission medium via a network interface device (e.g., a network interface component included in the communication components 964) and using any one of a number of well-known transfer protocols (e.g., hypertext transfer protocol (HTTP)). Similarly, the instructions 916 can be transmitted or received using a transmission medium via the coupling 972 (e.g., a peer-to-peer coupling) to the devices 970. The term "transmission medium" shall be taken to include any intangible medium that is capable of storing, encoding, or carrying the instructions 916 for execution by the machine 900, and includes digital or analog communications signals or other intangible media to facilitate communication of such software.

Many variations of the concepts and examples discussed herein will be apparent to those skilled in the relevant arts. For example, depending on the embodiment, certain acts, events, or functions of any of the methods, processes, or algorithms described herein can be performed in a different sequence, can be added, merged, or omitted (such that not all described acts or events are necessary for the practice of the various methods, processes, or algorithms). Moreover, in some embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To illustrate this interchangeability of hardware and software, various components, blocks, modules, and process actions are, in some instances, described generally in terms of their functionality. Whether such functionality is implemented as hardware or software depends upon the particular application and design constraints imposed on the overall system. The described functionality can thus be implemented in varying ways for a particular application, but such implementation decisions should not be interpreted as causing a departure from the scope of this document. Embodiments of the reverberation processing systems and methods and techniques described herein are operational within numerous types of general purpose or special purpose computing system environments or configurations, such as described above in the discussion of FIG. 9.

Various aspects of the invention can be used independently or together. For example, Aspect 1 can include or use subject matter (such as an apparatus, a system, a device, a method, a means for performing acts, or a device readable medium including instructions that, when performed by the device, can cause the device to perform acts), such as can include or use a method for preparing a reverberation signal for playback using headphones, the reverberation signal corresponding to a virtual sound source signal originating at a specified location in a local listener environment. Aspect 1 can include receiving, using a processor circuit, information about a reference impulse response for a reference sound source and a reference receiver in a reference environment, and receiving, using the processor circuit, information about a reference volume of the reference environment. Aspect 1 can further include determining (e.g., measuring or estimating or computing) information about a local reverberation decay for the local listener environment, and determining (e.g., measuring or estimating or computing) information about a local volume of the local listener environment. In an example, Aspect 1 includes generating, using the processor circuit, a reverberation signal for the virtual sound source signal using the information about the reference impulse response and the determined information about the local reverberation decay. Aspect 1 can further include scaling, using the processor circuit, the reverberation signal for the virtual sound source signal according to a relationship between the local volume and the reference volume.

Aspect 2 can include or use, or can optionally be combined with the subject matter of Aspect 1, to optionally include the scaling the reverberation signal for the virtual sound source signal includes using a ratio of the volumes of the local listener environment and the reference environment.

Aspect 3 can include or use, or can optionally be combined with the subject matter of one or any combination of Aspects 1 or 2 to optionally include the receiving information about the reference impulse response includes receiving information about a diffuse-field transfer function for the reference sound source and correcting the reverberation signal for the virtual sound source signal based on a relationship between a diffuse-field transfer function for the local source and the diffuse-field transfer function for the reference sound source.

Aspect 4 can include or use, or can optionally be combined with the subject matter of one or any combination of Aspects 1 through 3 to optionally include the receiving information about the reference impulse response includes receiving information about a diffuse-field transfer function for the reference receiver and scaling the reverberation signal for the virtual sound source signal based on a relationship between a diffuse-field head-related transfer function for the local listener and the diffuse-field transfer function for the reference receiver.

Aspect 5 can include or use, or can optionally be combined with the subject matter of one or any combination of Aspects 1 through 4 to optionally include the receiving information about the reference impulse response includes receiving information about a head-related transfer function for the reference receiver, and the head-related transfer function corresponds to a first listener using the headphones.

Aspect 6 can include or use, or can optionally be combined with the subject matter of Aspect 5, to optionally include receiving an indication that a second listener is using the headphones (e.g., instead of the first listener) and, in response, the method can include updating the head-related transfer function for the reference receiver to a head-related transfer function corresponding to the second listener.

Aspect 7 can include or use, or can optionally be combined with the subject matter of one or any combination of Aspects 1 through 6 to optionally include generating the reverberation signal for the virtual sound source signal using the information about the reference impulse response and the determined local reverberation decay, including adjusting a time-frequency envelope of the reference impulse response.

Aspect 8 can include or use, or can optionally be combined with the subject matter of Aspect 7, to optionally include the time-frequency envelope of the reference impulse response being based on smoothed and/or frequency-binned time-frequency spectral information from the impulse response, and wherein adjusting the time-frequency envelope of the reference impulse response includes adjusting the envelope based on a difference between corresponding portions of a time-frequency envelope of the local reverberation decay and the time-frequency envelope of the reference impulse response.

Aspect 9 can include or use, or can optionally be combined with the subject matter of one or any combination of Aspects 1 through 8 to optionally include generating the reverberation signal includes using an artificial reverberator circuit and the determined information about the local reverberation decay for the local listener environment.

Aspect 10 can include or use, or can optionally be combined with the subject matter of one or any combination of Aspects 1 through 9 to optionally include receiving information about the reference volume of the reference environment includes receiving a numerical indication of the reference volume or receiving dimensional information about the reference volume.

Aspect 11 can include or use, or can optionally be combined with the subject matter of one or any combination of Aspects 1 through 10 to optionally include determining the local reverberation decay time for the local environment includes producing an audible stimulus signal in the local environment and measuring the local reverberation decay time using a microphone in the local environment. In an example, the microphone is associated with a listener-specific device, such as a personal smart phone.

Aspect 12 can include or use, or can optionally be combined with the subject matter of one or any combination of Aspects 1 through 11 to optionally include determining the information about the local reverberation decay for the local listener environment includes measuring or estimating the local reverberation decay time.

Aspect 13 can include or use, or can optionally be combined with the subject matter of Aspect 12, to optionally include measuring or estimating the local reverberation decay time for the local environment includes measuring or estimating the local reverberation decay time at one or more frequencies corresponding to frequency content of the virtual sound source signal.

Aspect 14 can include or use, or can optionally be combined with the subject matter of one or any combination of Aspects 1 through 13 to optionally include determining information about the local room volume, including one or more of: receiving a numerical indication of the local volume of the local listener environment, receiving dimensional information about the local volume of the local listener environment, and using a processor circuit to compute the local volume of the local listener environment using a CAD drawing or 3D model of the local listener environment.

Aspect 15 can include or use, or can optionally be combined with the subject matter of one or any combination of Aspects 1 through 14 to optionally include providing or determining a reference reverberation decay envelope for the reference environment, the reference reverberation decay envelope having a reference initial power spectrum and reference decay time associated with the reference impulse response, determining a local initial power spectrum for the local listener environment by scaling the reference initial power spectrum by a ratio of the volumes of the reference environment and the local listener environment, determining a local reverberation decay envelope for the local listener environment using the local initial power spectrum and the determined information about the local reverberation decay, and providing an adapted impulse response. In Aspect 15, for a first interval corresponding to early reflections of the virtual sound source signal in the local listener environment, the adapted impulse response substantially equals the reference impulse response scaled according to the relationship between the local volume and the reference volume. In Aspect 15, for a subsequent interval following the early reflections, a time-frequency distribution of the adapted impulse response substantially equals a time-frequency distribution of the reference impulse response scaled, at each time and frequency, according to the relationship between the determined local reverberation decay envelope and the reference reverberation decay envelope.

Aspect 16 can include, or can optionally be combined with the subject matter of one or any combination of Aspects 1 through 15 to include or use, subject matter (such as an apparatus, a method, a means for performing acts, or a machine readable medium including instructions that, when performed by the machine, that can cause the machine to perform acts), such as can include or use a method for providing a headphone audio signal to simulate a virtual sound source at a specified location in a local listener environment. Aspect 16 can include receiving information about a reference impulse response for a reference sound source and a reference receiver in a reference environment, determining information about a local reverberation decay for the local listener environment, generating, using a reverberation processor circuit, a reverberation signal for a virtual sound source signal from the virtual sound source using the information about the reference impulse response and the determined information about the local reverberation decay, generating, using a direct sound processor circuit, a direct signal based on the virtual sound source signal at the specified location in the local listener environment, and combining the reverberation signal and the direct signal to provide the headphone audio signal.

Aspect 17 can include or use, or can optionally be combined with the subject matter of Aspect 16, to optionally include receiving information about a diffuse-field transfer function for the reference sound source, and receiving information about a diffuse-field transfer function for the virtual sound source, and generating the reverberation signal includes correcting the reverberation signal based on a relationship between the diffuse-field transfer function for the reference sound source and the diffuse-field transfer function for the virtual sound source.

Aspect 18 can include or use, or can optionally be combined with the subject matter of one or any combination of Aspects 16 or 17 to optionally include receiving information about a diffuse-field transfer function for the reference receiver, and receiving information about a diffuse-field head-related transfer function for a local listener in the local listener environment, and generating the reverberation signal includes correcting the reverberation signal based on a relationship between the diffuse-field transfer function for the reference receiver and the diffuse-field head-related transfer function for the local listener.

Aspect 19 can include or use, or can optionally be combined with the subject matter of one or any combination of Aspects 16 through 18 to optionally include receiving information about a reference volume of the reference environment, determining information about a local volume of the local listener environment, and generating the reverberation signal includes scaling the reverberation signal according to a relationship between the reference volume of the reference environment and the local volume of the local listener environment.

Aspect 20 can include or use, or can optionally be combined with the subject matter of Aspect 19, to optionally include scaling the reverberation signal, including using a ratio of the local volume to the reference volume.

Aspect 21 can include or use, or can optionally be combined with the subject matter of one or any combination of Aspects 19 or 20 to optionally include generating the direct signal for the virtual sound source signal includes applying a head-related transfer function to the virtual sound source signal.

Aspect 22 can include, or can optionally be combined with the subject matter of one or any combination of Aspects 1 through 21 to include or use, subject matter (such as an apparatus, a method, a means for performing acts, or a machine readable medium including instructions that, when performed by the machine, that can cause the machine to perform acts), such as can include or use an audio signal processing system comprising an audio input circuit configured to receive a virtual sound source signal for a virtual sound source, the virtual sound source provided at a specified location in a local listener environment, and a memory circuit comprising information about a reference impulse response for a reference sound source and a reference receiver in a reference environment, information about a reference volume of the reference environment, and information about a local volume of the local listener environment. Aspect 22 can include a reverberation signal processor circuit coupled to the audio input circuit and the memory circuit, the reverberation signal processor circuit configured to generate a reverberation signal corresponding to the virtual sound source signal and the local listener environment using the information about the reference impulse response, the information about the reference volume, and the information about the local volume.

Aspect 23 can include or use, or can optionally be combined with the subject matter of Aspect 22, to optionally include the reverberation signal processor circuit is configured to generate the reverberation signal using a ratio of the local volume and the reference volume to scale the reverberation signal.

Aspect 24 can include or use, or can optionally be combined with the subject matter of one or any combination of Aspects 22 or 23 to optionally include a headphone signal output circuit configured to provide a headphone audio signal comprising the reverberation signal and a direct signal corresponding to the virtual sound source signal.

Aspect 25 can include or use, or can optionally be combined with the subject matter of Aspect 24, to optionally include a direct sound processor circuit configured to provide the direct signal by processing the virtual sound source signal using a head-related transfer function.

Each of these non-limiting Aspects can stand on its own, or can be combined in various permutations or combinations with one or more of the other Aspects or examples provided herein.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein."

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features or methods or acts, it is to be understood that the subject matter defined in the appended claims is not necessarily limited to the specific features or acts described above. Rather, the specific features and acts described above are disclosed as example forms of implementing the claims.

What is claimed is:

1. A method for preparing a reverberation signal for playback using headphones, the reverberation signal corresponding to a virtual sound source signal originating at a specified location in a local listener environment, the method comprising:

generating, using a processor circuit, a reverberation signal for the virtual sound source signal using information about a reference impulse response and information about a local reverberation decay; and scaling, using the processor circuit, the reverberation signal for the virtual sound source signal according to a relationship between volume characteristics of the local listener environment and a reference environment;

wherein the generating the reverberation signal includes using an artificial reverberator circuit and the information about the local reverberation decay.

2. The method of claim 1, wherein the scaling the reverberation signal for the virtual sound source signal includes using a ratio of the volumes of the local listener environment and the reference environment.

3. The method of claim 1, further comprising receiving, using the processor circuit, information about the reference impulse response for a reference sound source and a reference receiver in the reference environment, wherein the receiving information about the reference impulse response includes receiving information about a diffuse-field transfer function for the reference sound source and correcting the reverberation signal for the virtual sound source signal based on a relationship between a diffuse-field transfer function for the local source and the diffuse-field transfer function for the reference sound source.

4. The method of claim 1, further comprising receiving, using the processor circuit, information about the reference impulse response for a reference sound source and a reference receiver in the reference environment, wherein the receiving information about the reference impulse response includes receiving information about a diffuse-field transfer function for the reference receiver and scaling the reverberation signal for the virtual sound source signal based on a relationship between a diffuse-field head-related transfer function for the local listener and the diffuse-field transfer function for the reference receiver.

5. The method of claim 1, further comprising receiving, using the processor circuit, information about the reference impulse response for a reference sound source and a reference receiver in the reference environment, wherein the receiving information about the reference impulse response includes receiving information about a head-related transfer function for the reference receiver, wherein the head-related transfer function corresponds to a first listener using the headphones.

6. The method of claim 1, wherein the generating the reverberation signal for the virtual sound source signal using the information about the reference impulse response and the local reverberation decay includes adjusting a time-frequency envelope of the reference impulse response.

7. The method of claim 6, wherein the time-frequency envelope of the reference impulse response is based on smoothed and frequency-binned time-frequency spectral information from the impulse response, and wherein the adjusting the time-frequency envelope of the reference impulse response includes adjusting the envelope based on a difference between corresponding portions of a time-frequency envelope of the local reverberation decay and the time-frequency envelope of the reference impulse response.

8. The method of claim 1, further comprising determining the local reverberation decay time for the local environment, including producing an audible stimulus signal in the local environment and measuring the local reverberation decay time using a microphone in the local environment.

9. The method of claim 1, further comprising determining the information about the local reverberation decay for the local listener environment, including measuring or estimating the local reverberation decay time, and wherein the measuring or estimating the local reverberation decay time for the local environment includes measuring or estimating the local reverberation decay time at one or more frequencies corresponding to frequency content of the virtual sound source signal.

10. The method of claim 1, further comprising determining information about the local room volume, including one or more of:

receiving a numerical indication of the local volume of the local listener environment;

receiving dimensional information about the local volume of the local listener environment; and using a processor circuit to compute the local volume of the local listener environment using a CAD drawing or 3D model of the local listener environment.

11. The method of claim 1, further comprising:

providing or determining a reference reverberation decay envelope for the reference environment, the reference reverberation decay envelope having a reference initial power spectrum and reference decay time associated with the reference impulse response;

determining a local initial power spectrum for the local listener environment by scaling the reference initial power spectrum by a ratio of the volumes of the reference environment and the local listener environment;

determining a local reverberation decay envelope for the local listener environment using the local initial power spectrum and the information about the local reverberation decay; and providing an adapted impulse response wherein:

for a first interval corresponding to early reflections of the virtual sound source signal in the local listener environment, the adapted impulse response substantially equals the reference impulse response scaled according to the relationship between the volume characteristics of the local listener environment and the reference environment; and for a subsequent interval following the early reflections, a tune-frequency distribution of the adapted impulse response substantially equals a time-frequency distribution of the reference impulse response scaled, at each time and frequency, according to a relationship between the determined local reverberation decay envelope and the reference reverberation decay envelope.

12. A method for providing a headphone audio signal to simulate a virtual sound source at a specified location in a local listener environment, the method comprising:

generating, using a reverberation processor circuit, a reverberation signal for a virtual sound source signal from the virtual sound source using information about a reference impulse response for a reference environment and information about a local reverberation decay for the local listener environment, wherein generating the reverberation signal includes scaling the reverberation signal based on a volume characteristics of the local listener environment and the reference environment;

and combining the reverberation signal with a direct signal to provide the headphone audio signal.

13. The method of claim 12, further comprising:

receiving the information about the reference impulse response for a reference sound source and a reference receiver in the reference environment;

receiving information about a diffuse-field transfer function for the reference sound source; and receiving information about a diffuse-field transfer function for the virtual sound source;

wherein the generating the reverberation signal includes correcting the reverberation signal based on a relationship between the diffuse-field transfer function for the reference sound source and the diffuse-field transfer function for the virtual sound source.

14. The method of claim 12, further comprising:

receiving the information about the reference impulse response for a reference sound source and a reference receiver in the reference environment;

receiving information about a diffuse-field transfer function for the reference receiver; and receiving information about a diffuse-field head-related transfer unction for a local listener in the local listener environment;

wherein the generating the reverberation signal includes correcting the reverberation signal based on a relationship between the diffuse-field transfer function for the reference receiver and the diffuse-field head-related transfer function for the local listener.

15. The method of claim 12, further comprising:

receiving information about a reference volume of the reference environment; and determining information about a local volume of the local listener environment;

wherein the generating the reverberation signal includes scaling the reverberation signal according to a ratio of the reference volume of the reference environment and the local volume of the local listener environment.

16. An audio signal processing system comprising:

an audio input circuit configured to receive a virtual sound source signal for a virtual sound source, the virtual sound source provided at a specified location in a local listener environment;

a memory circuit comprising:

information about a reference impulse response for a reference sound source and a reference receiver in a reference environment;

information about a reference volume of the reference environment; and information about a local volume of the local listener environment; and a reverberation signal processor circuit coupled to the audio input circuit and the memory circuit, the reverberation signal processor circuit configured to generate a reverberation signal corresponding to the virtual sound source signal and the local listener environment using the information about the reference impulse response, the information about the reference volume, and the information about the local volume.

17. The audio signal processing system of claim 16, wherein the reverberation signal processor circuit is configured to generate the reverberation signal using a ratio of the local volume and the reference volume to scale the reverberation signal.

18. The audio signal processing system of claim 16, further comprising a headphone signal output circuit configured to provide a headphone audio signal comprising the reverberation signal and a direct signal corresponding to the virtual sound source signal.

19. The audio signal processing system of claim 18, further comprising a direct sound processor circuit configured to provide the direct signal by processing the virtual sound source signal using a head-related transfer function.

20. The method of claim 12, further comprising generating, using a direct sound processor circuit, the direct signal based on the virtual sound source signal at the specified location in the local listener environment.

* * * * *